United States Patent [19]

Valliades et al.

[11] Patent Number: 4,850,107

[45] Date of Patent: Jul. 25, 1989

[54] RAZOR ASSEMBLY

[76] Inventors: John F. Valliades, 4 MacDonald Pl., Scarsdale, N.Y. 10503; George Mileos, 2500 Johnson Ave., Riverdale, N.Y. 10463

[21] Appl. No.: 253,055

[22] Filed: Oct. 4, 1988

[51] Int. Cl.[4] ..... B26B 21/44

[52] U.S. Cl. ..... 30/41; 30/86

[58] Field of Search ..... 30/41, 41.5, 50, 84, 30/90, 85, 86

[56] References Cited

U.S. PATENT DOCUMENTS

| | | | |
|---|---|---|---|
| 3,768,161 | 10/1973 | Miller | 30/41 |
| 3,969,817 | 7/1976 | DiBuono | 30/41 |
| 4,314,404 | 2/1982 | Ruiz et al. | 30/41 |
| 4,712,300 | 12/1987 | Hemmeter | 30/41.5 X |

*Primary Examiner*—Frank T. Yost
*Assistant Examiner*—Michael D. Folkerts
*Attorney, Agent, or Firm*—Notaro & Michalos

[57] ABSTRACT

A razor includes a head having a sponge for containing fluid exposed at the upper surface of the head both to allow the fluid content to be replenished and ready manual pressing of the sponge to expel fluid through a series of channels, formed in the head beneath the sponge, and through openings in the head to a position in advance of the length of the blade when the blade is moved along the skin of a user in a shaving motion responsive to a manual force applied to the sponge means.

8 Claims, 4 Drawing Sheets

RAZOR ASSEMBLY

BACKGROUND OF THE INVENTION

The present invention relates to a razor blade assembly with means for intermittently distributing a thin fluid film beneath the bottom of the blade while shaving.

One of the inconveniences of shaving occurs with the drying of soap lather which has been applied to the surface to be shaved. Such drying may affect the closeness of the shave or result in cuts, or both.

Various devices are disclosed in the patent literature which address this problem either directly or indirectly.

U.S. Pat. No. 4,716,652, for example, discloses a disposable shaver that has an elongated, unified handle and shaving lubricant container. A slidable manually-operated plunger, in one embodiment, is slidable along the length of the elongated device to rupture a thin membrane so as to allow contained lubricant to be expelled through a closeable opening in the wall of the unified handle and shaving lubricant container.

U.S. Pat. No. 3,412,465 discloses a resilient bulb-shaped reservoir for water or other wetting agents which can be incorporated into the handle of a razor. A tube extends from the bulb discharging liquid near the blades of the razor when the bulb is squeezed. The patent explains the significance of discharging water onto the face after shaving has begun, to remoisten the face.

U.S. Pat. No. 2,375,444 discloses a sponge like reservoir for water which is seated under a razor for keeping the cutting edge wet. The sponge is loaded up with water when the razor is rinsed, water is slowly discharged near the edge of the razor during the shaving operation.

U.S. Pat. No. 4,633,585 discloses a rather complex reservoir and valve arrangement for discharging water near the cutting edge of a razor. Other razors with reservoirs in the handle for discharging lubricant, in particular shaving cream, near the head of the razor are disclosed in U.S. Pat. Nos. 3,703,765, 4,653,188 and 4,716,652.

The use of the foam rubber sponge to act as a reservoir for water, in conjunction with shaving cream, dispensed from the handle of a razor is disclosed in U.S Pat. No. 4,314,404.

U.S. Pat. No. 4,562,644 illustrates a roller for discharging water. The patent shows a roller which carries a soap like lubricant that is activated by water to continuously lubricate the face during the shaving operation. A lubricating pad at the head of a razor is also disclosed in U.S. Pat. No. 4,697,342.

In U.S. Pat. No. 4,712,300, the razor head is entirely replaced by a semi-rigid water absorbing sponge-block razor holder.

Despite the constructions of the prior art, it remains desirable to have a razor which would supply fluid only on demand, not continuously, and which is simple in design and economical to manufacture.

SUMMARY TO THE INVENTION

In accordance with the invention, a razor is provided with an improved arrangement for conveying a film of fluid in advance of a length of the razor blade when the blade is moved along the skin of a user in a shaving motion.

The razor of the invention includes recess for housing a sponge means for containing a fluid and means for conveying a thin film of fluid from the sponge means to a position in advance of a length of the razor blade responsive to the application of a manual force to the spring means.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
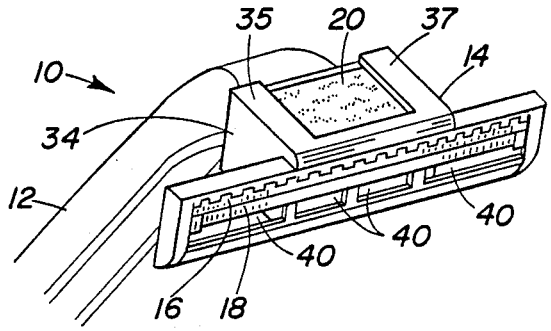
FIG. 1 is a partial, front perspective view of a razor embodying the invention.
Figure 2:
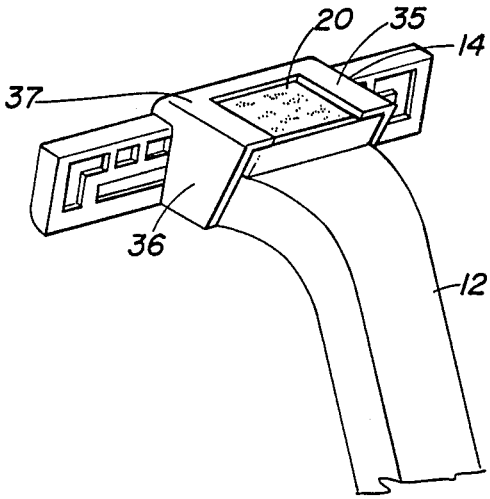
FIG. 2 is a rear perspective view of FIG. 1.

Referring to the figures of the drawings in detail, particularly FIGS. 1 and 2, a razor 10 is composed of handle 12 and a razor head 14 connected to the handle 12.

The head 14 includes two razor blades 16 and 18. If preferred, a single razor blade may be utilized.

A sponge 20 is housed in a recess formed, in the illustrated embodiment, between the head 14 and the handle 12.

Figure 3:
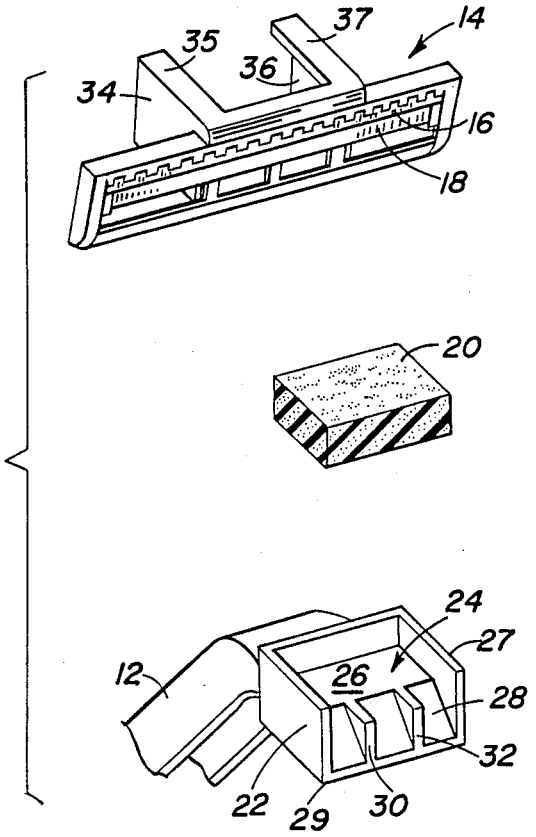
FIG. 3 is an exploded view of a portion of a razor embodying the invention.

As shown in FIG. 3, the handle 12, at the razor head end, is provided with an expanded generally U-shaped fitting 22 with an upwardly open recessed seating area 24 for reception of the sponge which is composed of a planar ledge 26 intermediate the upper edge 27 and lower end 29 of the fitting 22 and a ramp 28 extending from the ledge 26 to the lower end 29. Two laterally-spaced, triangular-shaped projections 30, 32 project from the ramp 28 to form three channels along the ramp. The sponge 20 is designed to seat upon the planar ledge 26 and on the top of the projections 30, 32.

The razor head 14 includes a housing cap having opposite side walls 34, 36 and upper lips 35, 37 dimensioned so that the cap can be closely fitted onto the housing 22 with the side walls 34, 36 engaged over the sides of housing 22 and the lips 35, 37 mounted on and projecting over the upper edge 27 to overlie and hold the sponge 20 in place. In the razor head 14, openings 40 are formed beneath the lower razor blade 18 at the lower end of the ramp and openings 42 are formed adjacent the lower razor blade 18 at the upper end of the ramp as may be seen in FIG. 4.

Figure 4:
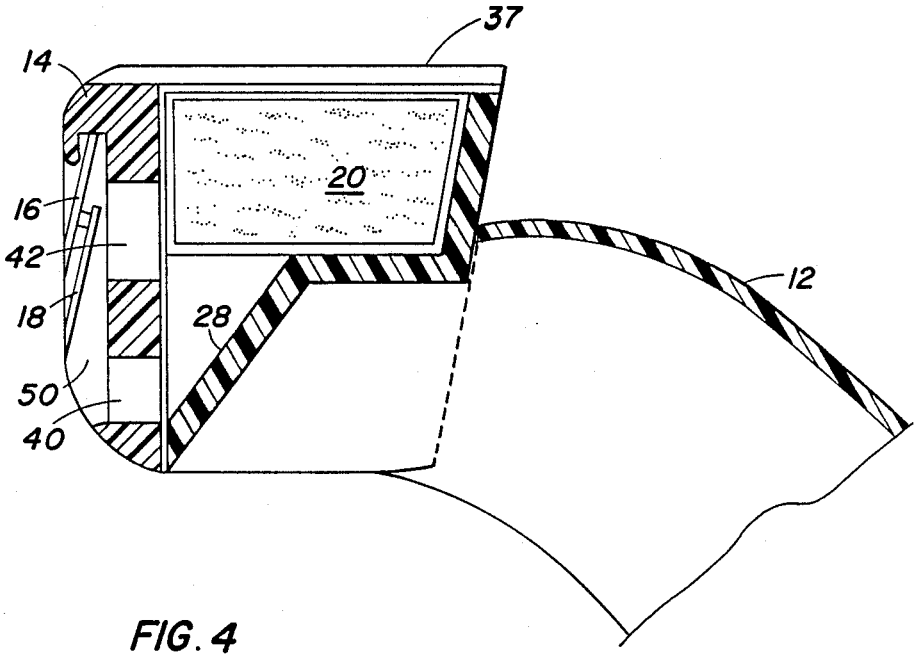
FIG. 4 is a side sectional view of the head arrangement of a razor according to the invention.
Figure 5:
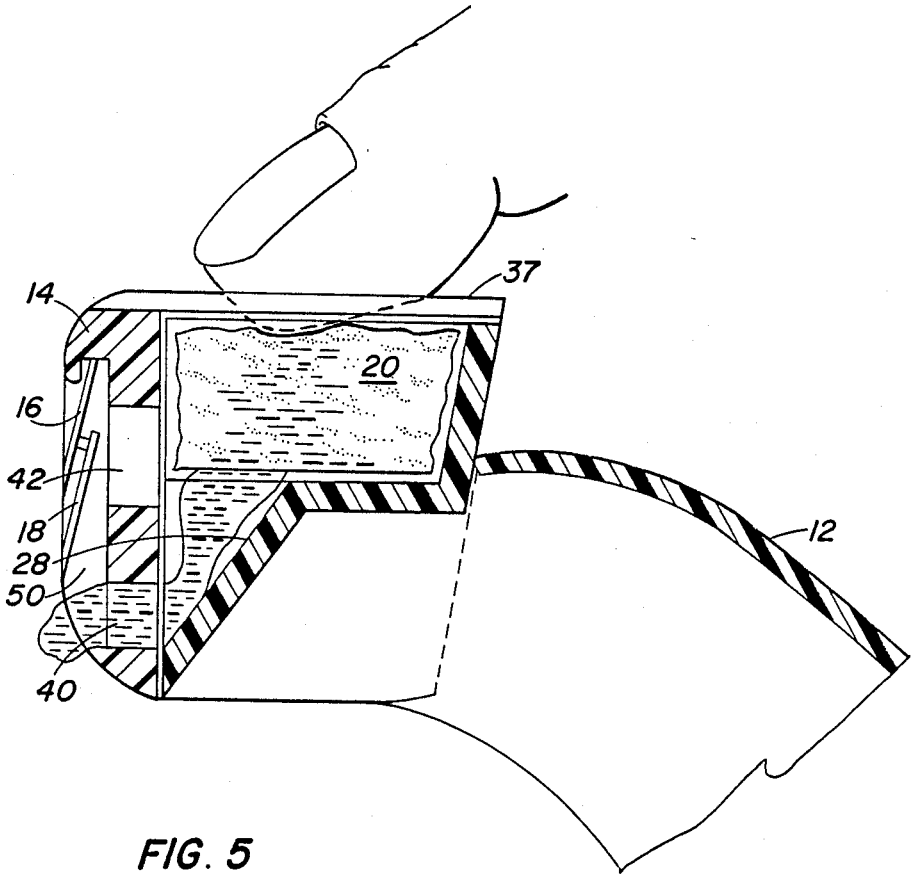
FIG. 5 is a view, similar to FIG. 4, illustrating the operation of a razor according to the invention.

As shown in FIGS. 4 and 5, the sponge 20 is located at the top of the head. The upper surface of the sponge 20, between the upper lips 35, 37 is exposed for two purposes. First, when the razor is held beneath a faucet, the resilient material of the sponge 20 will absorb water. Secondly, in use, water may be intermittently conveyed from the sponge 20 by pressing the sponge 20, for example, as shown in FIG. 5. Pressing of the sponge 20 causes a discrete amount of fluid contained in the sponge to be expelled into each of the three channels along the ramp 28 and through the openings 40. The openings 40 are sized to allow only a thin film of fluid to be expelled below the blade into a space 50 between the lower razor blade and the head so that a film of fluid spreads along the length of the blade via capillary action. Thus, in operation, manual pressing of the sponge 20 causes fluid to be conveyed through along the ramp via the channels and through openings to the space and therefrom to a position in advance of a length of the razor blade when the blade is moved along the skin of a user in a shaving motion.

Although specific embodiments of the invention has been disclosed, those skilled in the art will recognize that changes may be made to the disclosed embodiments without departing from the scope and spirit of the invention. For example, the razor head may be permanently fixed to the handles or may be an replaceable injector type head. While a double blade arrangement is illustrated, the head could be provided with only a single blade. The fluid used may simply be tap water or water with a lubricant or soap or a scented fluid. The sponge may be impregnated with a lubricant that discharges slowly when mixed with water.

The invention claimed is:

1. An improved razor assembly of the type having a handle, a razor head connected to the handle, and a razor blade mounted to the razor head and having an outer surface for facing a surface to be shaved, and an inner surface facing the razor head, the improvement comprises:

a shaped fitting connected between the handle and the razor head and defining an upwardly open recess;

sponge means for containing a fluid, disposed in the recess, the sponge means having an upper manually pressible portion for permitting manual pressing of the sponge means to expel fluid therefrom; and conveying means for conveying a film of fluid from the sponge means on a side of the razor blade facing the inner surface of the razor blade and to a position in advance of a length of the razor blade when the blade is moved along the skin of a user in a shaving motion, the conveying means conveying the film of fluid in response to a manual force applied to the upper portion of the sponge means to expel fluid from the sponge means.

2. An improved razor assembly according to claim 1 wherein the shaped fitting comprises a U-shaped fitting having side walls on opposite sides of the recess, the side walls extending to the razor head, the sponge means comprising a sponge positioned in the recess between the side walls, the upper manually pressible portion of the sponge means comprising an upper surface of the sponge which is exposed in the upwardly open recess for receiving a manual force.

3. An improved razor assembly as set forth in claim 2 wherein the fitting includes one portion connected to the handle and carrying a ledge defining a lower end of the recess for receiving a sponge, and another portion connected to the razor head and carrying the side walls of the fitting.

4. An improved razor assembly as set forth in claim 1, wherein said conveying means comprises a plurality of channels at laterally adjacent positions along at least part of the length of the head intermediate the sponge means and the razor blade.

5. An improved razor assembly as set forth in claim 1 to wherein said sponge means comprises a sponge.

6. An improved razor of the type having a handle, a razor head connected to the handle, and a razor mounted to the head, the improvement comprising a fitting on the handle, the fitting including a planar ledge and an inclined ramp having a first end connected to the ledge and a second end, the razor head being mounted to the fitting, the razor head having an opening located beneath a length of the razor blade proximate to and in fluid communication with the second end of the ramp, a sponge mounted for containing a fluid overlying the ramp and the ledge, the razor head including means for holding the sponge in place, whereby compression of the sponge results in the conveyance of fluid from the sponge, along the ramp and into the opening to form a film of fluid at a position in advance of a length of the razor blade when the blade is moved along the skin of a user in a shaving motion.

7. An improved razor as set forth in claim 6 further comprising a projection mounted on said ramp so as to divide said ramp into a plurality of channels in fluid communication with the openings.

8. An improved razor assembly of the type having a handle, a razor head connected to the handle, and a razor blade mounted to the head, the improvement comprising:

a sponge for containing a fluid;

means for housing the sponge, said housing means including a recess for receiving the sponge; and means for conveying a film of fluid from the sponge means to a position in advance of a length of the razor blade when the blade is moved along the skin of a user in a shaving motion responsive to a manual force applied to the sponge, said conveying means comprising a plurality of channels in fluid communication with said recess, at least one opening in the head beneath the razor in fluid communication with said channels, a ledge at the bottom of the sponge receiving recess, a ramp connected to the ledge, and at least two projections mounted to the ledge at laterally spaced intervals.

* * * * *